United States Patent [19]

Swart

[11] Patent Number: 4,719,737

[45] Date of Patent: Jan. 19, 1988

[54] INTERLOCKING CONSTRUCTION BLOCK

[75] Inventor: Pieter Daniel Swart, Verwoerdburg, South Africa

[73] Assignee: Sylsands Securities (Properietary) Limited, Pretoria West, South Africa

[21] Appl. No.: 16,625

[22] Filed: Feb. 19, 1987

[30] Foreign Application Priority Data

Feb. 26, 1986 [ZA] South Africa ..... 86/1435

[51] Int. Cl.[4] ..... E04B 5/04

[52] U.S. Cl. ..... 52/605; 52/608

[58] Field of Search ..... 52/608, 596, 611, 609, 52/606, 610, 605; 446/125

[56] References Cited

U.S. PATENT DOCUMENTS

| | | | |
|---|---|---|---|
| 1,687,342 | 10/1928 | MacVeigh et al. | 52/606 X |
| 3,557,505 | 1/1971 | Raul | 52/608 X |
| 4,083,190 | 4/1978 | Pey | 52/608 X |

*Primary Examiner*—Carl D. Friedman

*Attorney, Agent, or Firm*—Ladas & Parry

[57] ABSTRACT

An interlocking construction block has a first, two second and two third parts each having major faces lying in parallel planes. The block is generally V-shaped when viewed normally to the parallel planes and the height of the third parts is only one half of that of the first and second parts, enabling the block to be interlocked neatly with other similar blocks to form a wide variety of structures.

10 Claims, 10 Drawing Figures

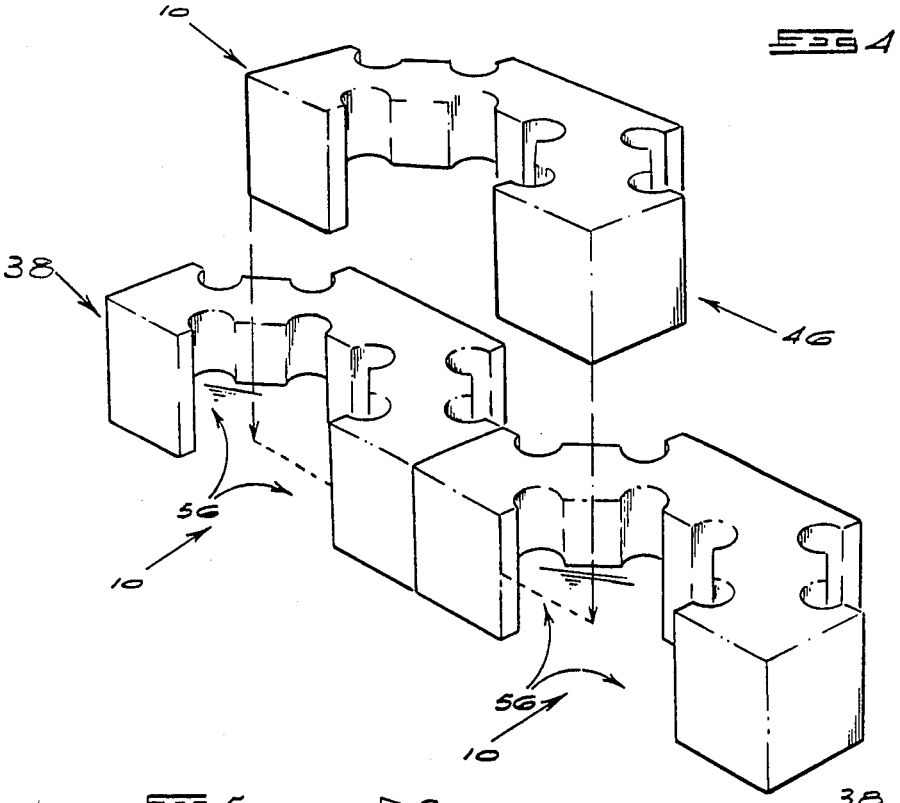
FIG 4
FIG 5
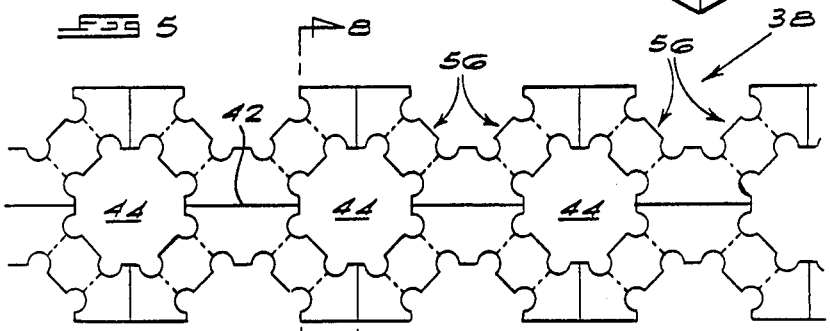
FIG 6
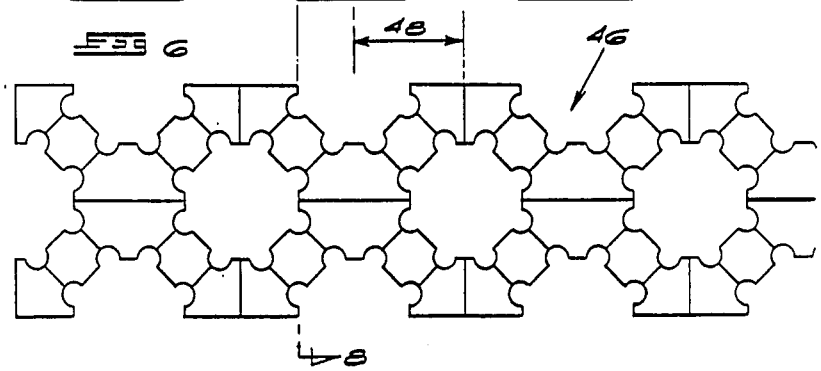

FIG. 7
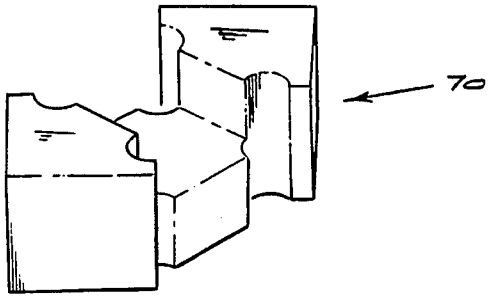
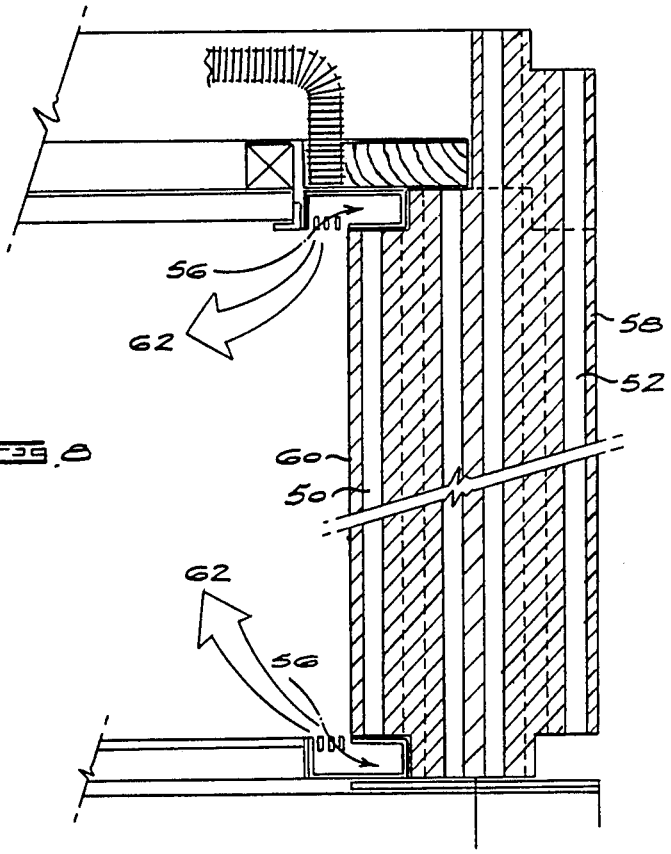
FIG. 8

INTERLOCKING CONSTRUCTION BLOCK

BACKGROUND TO THE INVENTION

This invention relates to an interlocking construction block.

Various different interlocking construction blocks are known. The known blocks are rectangular and they all have projections on one major face and recesses in the opposite major face. The recesses are complemental in shape to the projections and are capable of receiving the projections of adjacent blocks in an interlocking fit.

The present invention seeks to provide a novel interlocking block which has a wide range of possible applications.

SUMMARY OF THE INVENTION

An interlocking construction block according to this invention includes a first part having a first surface lying in a first plane and a second surface lying in a second plane spaced apart from and parallel to the first plane, two second parts which are spaced away from the first part and from each other and which each have first and second surfaces lying in the first and second planes respectively, and two third parts each located between the first part and one of the second parts, each third part having a first surface lying in a third plane which is parallel to, but between the first and second planes and a second surface which lies in the second plane, the parts being integral with one another to define a block which has generally a right angled V-shape when the block is viewed in a direction normal to the first, second and third planes.

A block such as that defined above can be interlocked with other identical blocks in various ways, the interlocking action being possible because the first surface of each third part is not coplanar with the first or second surfaces of the first and second parts, but lies in a plane, preferably midway, therebetween. A first block as defined above can be interlocked with another identical block to form a rectangular, brick-like body. In a preferred form of the invention, there is a series of grooves formed in the parts, the grooves extending vertically when the block is laid with its first, second and third planes horizontal, the grooves being positioned to cooperate with the grooves of other identical blocks when the blocks are interlocked to form a structure in which the blocks are laid in superimposed courses. The cooperating grooves then provide channels for services or for a grout which will cement the blocks to one another in the structure.

BRIEF DESCRIPTION OF THE DRAWINGS

FIG. 4 shows how blocks of FIG. 1 type can be interlocked to form a wall;

FIGS. 5 and 6 show plan views of alternate courses in a wall;

FIG. 7 shows a perspective view of another block which is used to complement a FIG. 1 block;

FIG. 8 shows, in a section, at the line 8—8 in FIGS. 5 and 6, a wall formed using blocks of the invention;

DESCRIPTION OF A PREFERRED EMBODIMENT

Figure 1:
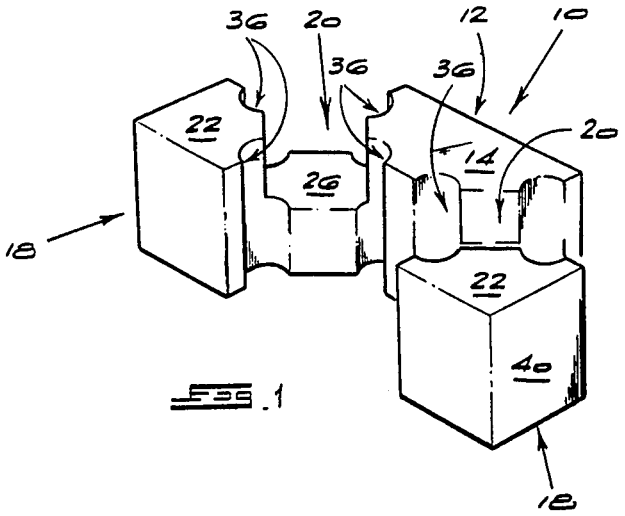
FIG. 1 shows a perspective view of a block according to the invention.
Figure 2:
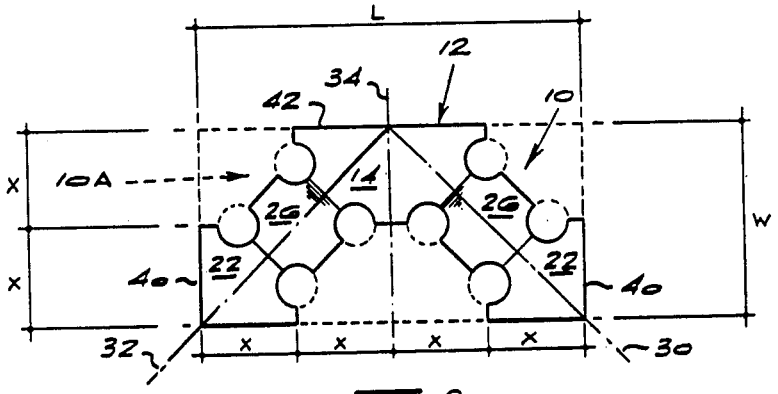
FIG. 2 shows a plan view of the block of FIG. 1.
Figure 3:
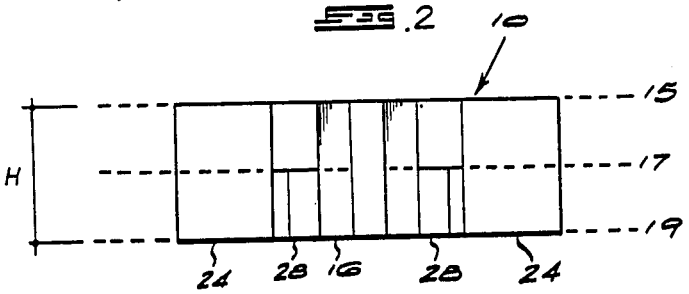
FIG. 3 shows a view of the block in the direction of the arrow 3 in FIG. 1.

The integral block 10 seen in FIGS. 1 to 3 has a first part 12 which has a first surface 14 lying in a first plane 15 and a second surface 16 which is spaced from and parallel to the first face. The second surface lies in a second plane 19. The block 10 also has two second parts 18 which are spaced from the first part by third parts 20. The second parts 18 have first surfaces 22 which lie in the same plane 15 as the surface 14 and second surfaces 24 which lie in the same plane 19 as the surface 16. The third parts have first surfaces 26 which are parallel to the surfaces 14, 16, 22 and 24 but which lie in a plane 17 which is exactly midway between the planes 15 and 19. The third parts also have surfaces 28 which lie in the same plane 19 as the surfaces 16 and 24.

When the planes 15, 17 and 19 are horizontal, and the block is viewed vertically from above, as in FIG. 2, the block has generally a V-shape, with the second and third parts on one side having a bisecting plane 30 which is at right angles to the corresponding bisecting plane 32 of the second and third parts on the other side. The whole block is symmetrical about a bisecting plane 34.

The block 10 is also formed with a series of arcuate grooves 36 which extend vertically when the block is laid with its planes 15, 17 and 19 horizontal. The block can be formed of a wide variety of materials such as concrete or other cementitious mix, clay, plastics or wood. It is anticipated that blocks 10 can be used in children's construction sets, as well as in full-scale building. The blocks can also be used in paving applications.

A typical block 10 for use in domestic building operations will have an overall length L of 340 mm and an overall width W of 170 mm with the arcuate grooves 36 being defined by a radius of 10 mm. The dimension X in such a block would be 85 mm.

As will be apparent from the illustrations, and especially FIG. 2, the part 12 is generally trapezoidal, the parts 18 generally triangular and the parts 20 generally square when viewed normally to the planes 15, 17 and 19.

FIG. 2 shows how a block 10 can be interlocked with another identical block 10A (illustrated in broken outline) to form a rectangular unit. The block 10A is inverted with respect to the block 10 i.e. its plane 19 is uppermost and its plane 15 at the bottom. This is permitted because the parts 20 are of half-height only and thus are able to combine with one another to form a full height.

When forming an interlocking wall using courses of blocks 10, it is preferred to arrange them in what can be termed "stretcher-bond" fashion rather than merely laying them one on top of the other as illustrated in FIG. 2. FIGS. 4 to 6 illustrate how this is done.

The bottom course 38 seen in plan view in FIG. 5 contains blocks 10 which are inverted from the positions seen in FIGS. 1 to 3. In other words, the plane 19 is uppermost and the plane 15 is at the bottom. The surfaces 40 of the second parts 18 of adjacent blocks 18 are in close abutment with one another in the longitudinal direction, while the surfaces 42 of the first parts 12 are in close abutment with the corresponding surfaces of adjacent opposed blocks. Generally hexagonal spaces 44 exist between the blocks.

FIGS. 4 and 6 illustrate the next course 46 of blocks 10, which are also inverted from the positions seen in FIG. 1. It will be seen from FIG. 4 that the course 46 will only extend above the course 38 by half the overall height of a block 10, because of the interlocking which takes place between the third parts 20 of the blocks. The upwardly extending parts of the blocks 10 in the course 46 provide an interlocking guide for the next course. The course 46 is identical to the course 38, but is dispaced sideways relative to it by a distance 48, as seen in FIGS. 5 and 6. A full height wall is built up by alternating the courses 38 and 46.

Instead of having the blocks 10 in the courses 38 and 46 inverted as shown, it is also possible to have them the same way up as the block 10 of FIGS. 1 to 3.

From FIGS. 2, 5 and 6, it will be seen that the grooves 36 cooperate with one another to form vertical passages in the wall which extend for the full height of the wall. This is an important feature of the block 10, since these passages permit ready installation of electrical conduits and other services in the body of the wall. FIG. 8 schematically shows a cross-sectional view through a wall formed from the blocks 10, and shows that the outermost passages 50 and 52 formed by the relevant grooves 36 are very close to the edge of the wall. This means that access to the passage can easily be gained merely by drilling or cutting a short distance into the wall at the appropriate places. There is no requirement for chasing as is the case with conventional rectangular bricks.

If the blocks 10 are accurately formed, the wall requires no plastering to achieve a pleasing finish and can be directly painted or otherwise treated.

Referring again to FIGS. 5, 6 and 8, it will be seen that there is a total of six passages across the width of the resulting wall. Only some of these passages will be used for services. At least some of the remaining passages are grouted up with an appropriate cementitious or other adhesive mix to bond the blocks to one another firmly. It is for this reason that it is preferred to lay the first course 38 in the manner seen in FIG. 4, since the gaps 56 which exist at the bottom of the wall permit ready access to the passages for grouting nozzles. The invention contemplates the use of a manifold which will be supplied with the appropriate grout under pressure and which will have a series of grouting nozzles communicating with the manifold. The manifold will be positioned adjacent the wall and the nozzles will be shaped to enter the gaps 56 and align with the correct passages in the wall. Then the grout which is supplied to the manifold will automatically be directed into the correct passages without filling those passages required for services.

Prior to the grouting operation, the small gaps which will exist between mating faces of the blocks can be sealed up by pumping an appropriate sealant through some or all of the passages in the wall. This will preferably be done in a closed circuit, with that sealant which does not find its way into a gap being returned from the wall for re-use. The sealant will therefore not fill the passages which can then be used for grouting or for services.

FIG. 8 indicates yet another use for the passages in the wall. The outer surface of the wall is indicated with reference numeral 58 and the inner surface with the numeral 60. At least some of the outermost passages 50 and 52 are left vacant and form conduits for the passage of air. The air which is present in the outer passages 52 will be heated up by sunshine impinging on the outer surface 58 and can be directed, with appropriate piping, through the passage 50 for venting into a room as indicated by the arrows 62. During summer, the passages 50 can be used for distributing conditioned air. Once again, the gaps 56 prove important, since they provide openings at the bottom of the wall through which the air can leave the wall and enter the room.

With a wall formed using alternating courses 38 and 46 as described earlier, there will also be gaps 56 at the upper end of the wall which permit distribution of cooled or heated air.

FIG. 7 illustrates a block 70 which can be mated with a block 10 to provide a pleasing end to a course 38 or 46. The block 70 is constituted by one-half of a block 10 as bisected by the bisecting plane 34 in FIG. 2.

From the dimensional relationships which are evident from FIG. 2 it will be seen that blocks 10 according to the invention can be mated with one another in a variety of different ways to form different structures.

Figure 9:
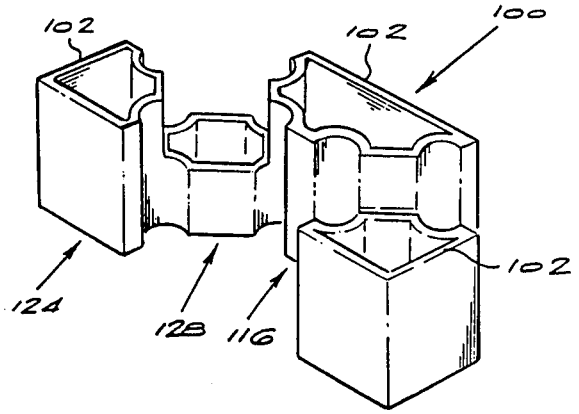
FIG. 9 shows a perspective view of a second embodiment of block according to the invention.

It should also be noted that while the block 10 described above is of solid construction, it is also possible for the block to be hollow as illustrated in FIG. 9 which shows a toy construction block 100 formed of plastics material. In FIG. 9, the surfaces corresponding to the surfaces 14 and 22 of the block 10 of FIGS. 1 to 3 are defined by the free edges 102 of the walls making up the block. The coplanar surfaces corresponding to the surfaces 16, 24 and 28 of FIGS. 1 to 3 are closed.

Figure 10:
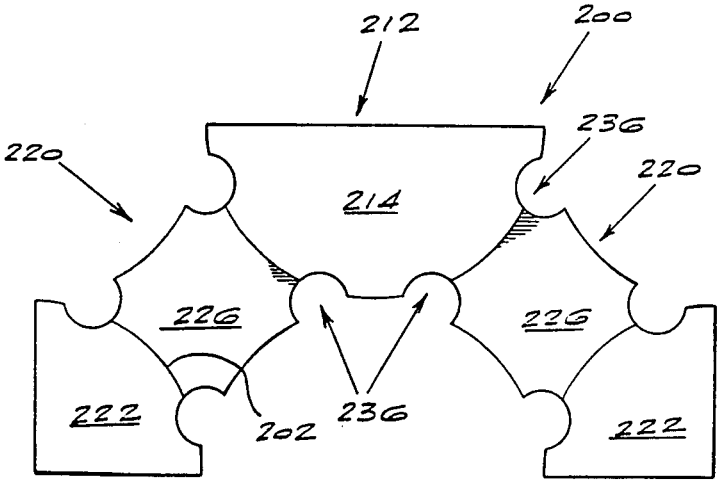
FIG. 10 shows a plan view of a third embodiment of block according to the invention.

FIG. 10 shows another embodiment of block according to the invention in a plan view. In this Figure, parts corresponding to those of the first embodiment of FIGS. 1 to 3 are designated with the same numerals with the prefix "2". In this case it will be seen that the majority of the operatively vertical surfaces of the block are arcuate in shape. A block of this kind may, for instance can be used in marble work and has the advantage that the arcuate faces such as those designated 202 and 204 can be cut from the marble using a circular diamond cutting crown.

I claim:

1. An interlocking construction block including a first part having a first surface lying in a first plane and a second surface lying in a second plane spaced apart from and parallel to the first plane, two second parts which are spaced away from the first part and from each other and which each have first and second surfaces lying in the first and second planes respectively, and two third parts each located between the first part and one of the second parts, and one of the second parts, each third part having a first surface lying in a third plane which is parallel to, but between the first and second planes and a second surface which lies in the second plane, the parts being integral with one another to define a block which has generally a right angled V-shape when the block is viewed in a direction normal to the first, second and third planes.

2. An interlocking construction block according to claim 1 wherein the third plane is mid-way between the first and second planes.

3. An interlocking construction block according to claim 1 wherein the first part is generally trapezoidal in shape when viewed in a direction normal to the first, second and third planes.

4. An interlocking construction block according to claim 1 wherein the second parts are generally triangular when viewed in a direction normal to the first, second and third planes.

5. An interlocking construction block according to claim 1 wherein the third parts are generally square in shape when viewed in a direction normal to the first, second and third planes.

6. An interlocking construction block according to claim 1 wherein the block is symmetrical about a plane bisecting the V-shape.

7. An interlocking construction block according to claim 1 wherein at least some surfaces of the parts which are perpendicular to the first, second and third planes are arcuate in shape.

8. An interlocking construction block according to claim 1 wherein the parts of the block are formed with grooves which are perpendicular to the first, second and third planes.

9. An interlocking construction block according to claim 8 wherein the grooves extend vertically when the block is laid with its first, second and third planes horizontal, the grooves being positioned to cooperate with the grooves of other identical blocks.

10. An interlocking construction block according to claim 1 wherein the block is hollow.

* * * * *